US005791820A

United States Patent [19]

Rempel

[11] Patent Number: 5,791,820

[45] Date of Patent: Aug. 11, 1998

[54] METHOD AND APPARATUS FOR IMPLANTING SCREW-IN PILINGS OR ANCHORS IN THE GROUND

[76] Inventor: Jake Rempel, Box 1463, Valleyview, Alberta, Canada, T0H 3N0

[21] Appl. No.: 736,663

[22] Filed: Oct. 25, 1996

[51] Int. Cl.[6] ..... E02D 7/00

[52] U.S. Cl. ..... 405/232; 73/862.37; 73/862.323; 405/231; 405/303; 254/264

[58] Field of Search ..... 405/232, 258, 405/259.1, 303; 73/862.49, 862.37, 862.25, 862.323, 744; 254/264

[56] References Cited

U.S. PATENT DOCUMENTS

| | | | |
|---|---|---|---|
| 1,929,055 | 10/1933 | Carr | 254/30 |
| 2,640,681 | 6/1953 | Johnston | 254/264 |
| 2,775,889 | 1/1957 | Decker | 73/862.323 X |
| 3,100,991 | 8/1963 | Shipley | 73/862.37 X |
| 3,148,739 | 9/1964 | Mattingly et al. | 405/232 X |
| 3,356,163 | 12/1967 | Rowe et al. | 405/232 X |
| 3,368,396 | 2/1968 | Van Burkleo et al. | 73/862.25 |
| 3,763,654 | 10/1973 | Matsushita | 405/232 |
| 3,828,562 | 8/1974 | Petres | 73/862.49 X |
| 4,133,206 | 1/1979 | Hida et al. | 73/862.49 |
| 5,282,701 | 2/1994 | An et al. | 405/232 X |
| 5,433,119 | 7/1995 | Rogers | 73/862.37 X |

FOREIGN PATENT DOCUMENTS

| | | | |
|---|---|---|---|
| 838379 | 4/1970 | Canada . | |
| 967145 | 5/1975 | Canada . | |
| 1076835 | 5/1980 | Canada . | |
| 0711236 | 1/1980 | U.S.S.R. | 405/232 |
| 0885452 | 11/1981 | U.S.S.R. | 405/232 |

*Primary Examiner*—Dennis L. Taylor
*Attorney, Agent, or Firm*—Dickinson Wright PLLC

[57] ABSTRACT

There is provided a new and useful apparatus for use in implanting a screw-in piling or anchor into the subsoil. The apparatus comprises an insertion means mounted to a skid-steer loader combined with a first load bearing measuring device to measure the load required to insert the piling or anchor and a second load bearing measuring device releasably attachable to the anchor to measure the holding strength of the piling or anchor within the subsoil.

2 Claims, 4 Drawing Sheets

METHOD AND APPARATUS FOR IMPLANTING SCREW-IN PILINGS OR ANCHORS IN THE GROUND

FIELD OF THE INVENTION

This application relates to a method and apparatus for the implanting of screw-in pilings or anchors into the subsoil.

BACKGROUND OF THE INVENTION

Screw-in pilings or anchors are required to be implanted into the subsoil in order to act as anchors to carry load-bearing members such as for drilling rigs and building foundations. Such pilings and anchors must be implanted into the subsoil in such a manner so as to be confident that they will not pull free from the subsoil under heavy load conditions. In fact, government regulations require that the pilings or anchors meet certain minimum pull-test standards once implanted, before they can be used.

To that end, it is known in the prior art to test the subsoil conditions prior to insertion of the piling or anchor in order to estimate the density of the subsoil and hence, derive an estimate of the holding strength at that location. Reference is made for example to Canadian Patent No. 838,379 of Rowe and Dixon, issued Apr. 7, 1970.

It is further known to the prior art to test the piling or anchor after it has been inserted to determine the holding strength of the implanted piling or anchor. Such a test typically involves a straight axial pull on the piling or anchor until the subsoil holding it gives way and it is released or until the force exerted on the anchor meets or exceeds the government requirements. Reference is made to Canadian Patent No. 1,076,835 of Tremblay, issued May 6, 1980.

However, such apparatus are not adapted to perform both of the above-noted testing functions.

It would thus be advantageous to the art to have a single such apparatus, capable of testing the holding conditions of the subsoil while the anchor is being implanted as well as confirming that holding strength by means of a constant pull test on the anchor once it is implanted. Further, such an apparatus ought to be adaptable to operate easily over uneven terrain. While it is known to mount a post hole digger on a conventional skid-steer loader, see for example Canadian Patent No. 967,145 of Coontz, issued May 6, 1975, such a device does not provide the testing capabilities thus described as desirable.

SUMMARY OF THE INVENTION

In one aspect of the invention there is provided an apparatus mountable to a skid-steer loader for use in the implanting of screw-in pilings or anchors into the subsoil. The apparatus comprises a means for holding the anchor in position for inserting into subsoil of the ground, insertion means for inserting the anchor into subsoil of the ground, a first load bearing measuring device connected to the insertion means to measure the load required to overcome the resistive force of the subsoil and a second load bearing measuring device releasably attachable to the anchor to test and measure the holding strength of the anchor within the subsoil.

In a preferred embodiment of the invention, the insertion means comprises a device which applies an axial force to the anchor sufficient to maintain advance of the anchor into the subsoil and sufficient torque to the anchor to cause rotation of the anchor upon application of the axial force to allow the anchor to be inserted into the subsoil.

In another preferred embodiment of the invention, the first load bearing measuring device comprises a pressure gauge to measure the pressure required to insert the anchor into the subsoil, those pressure readings then converted to axial force and torque units of measure.

In still another preferred embodiment of the invention, the second load bearing measuring device comprises a hydraulic ram and a connection means to connect to the anchor once implanted in the subsoil, and means for applying a selectively incremental increasing upwards pull on the anchor and a device to measure the pressure being exerted upon the member, the pressure reading then converted to axial force units of measure.

There is thus provided in the present invention an apparatus mountable to a skid-steer loader and method for the insertion of a member into the subsoil, to test the force required to insert the anchor and to apply a selectively incremental increasing force to the member once inserted in order to test the holding strength of the member within the subsoil.

BRIEF DESCRIPTION OF THE DRAWINGS

These and other advantages of the invention will become apparent upon reading the following detailed description and upon referring to the drawings in which.

Figure 1:
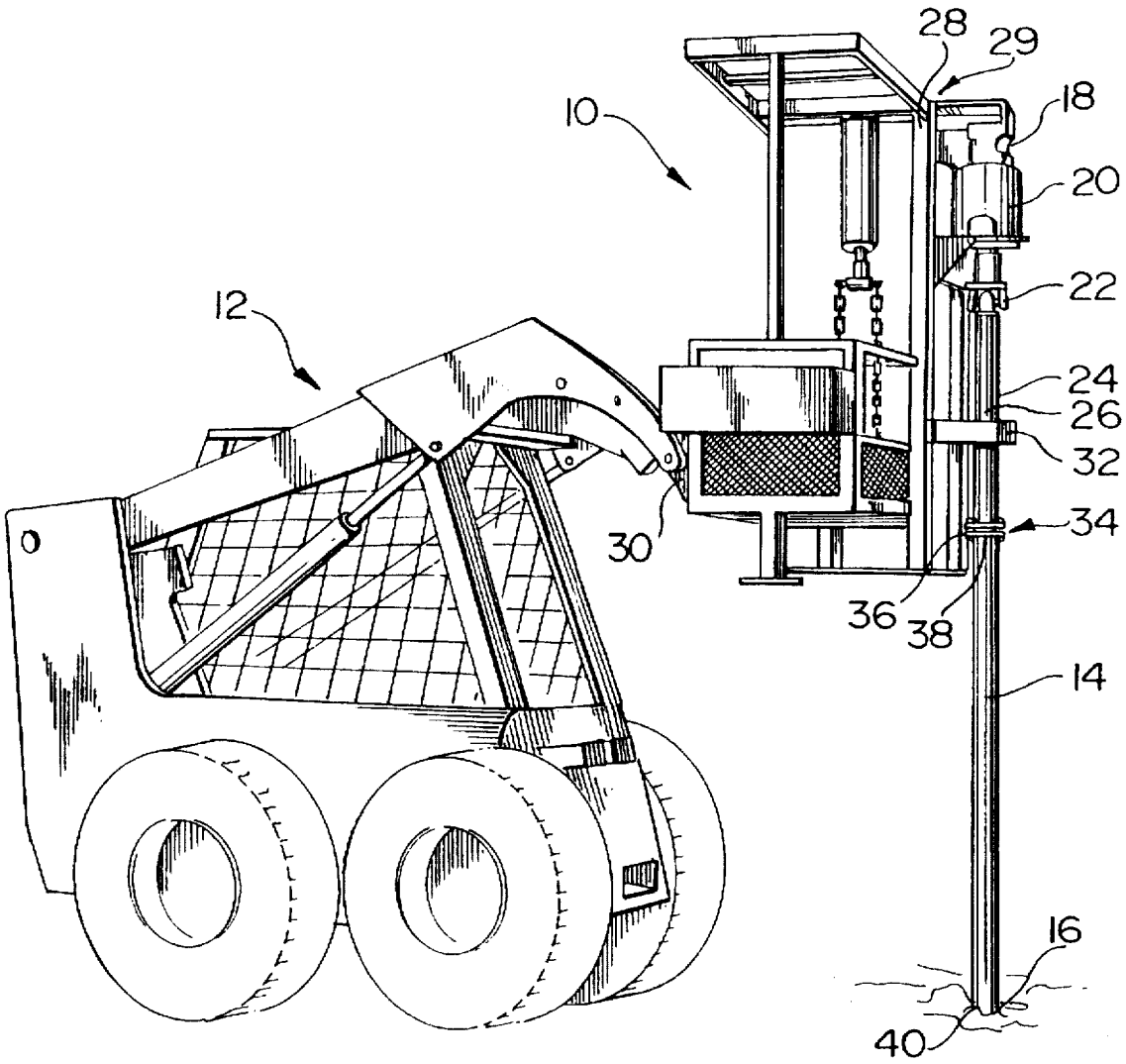
FIG. 1 is a perspective view of the invention in use with a conventional skid-steer loader.

While the invention will be described in conjunction with illustrated embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE INVENTION

In the following description, similar features in the drawings have been given similar reference numerals.

Turning to the drawings, FIG. 1 illustrates an apparatus 10 mounted to a conventional skid-steer loader 12, such as a Bobcat™, for implanting a screw-in piling or anchor 14 into the subsoil of the ground 16 at a desired location without the necessity of pre-drilling a hole for the anchor 14.

The apparatus 10 comprises a hydraulic motor 18 and a gear reduction box 20 connected by a U-joint 22 to a drive shaft 24 which operates a hydraulic ram 26. The apparatus is in turn mounted on a main support frame 28, as generally shown at 29 and in turn mountable on to the skid-steer loader 12 by quick-connect mounting flanges 30.

The U-joint 22 permits rotative movement while the drive shaft 24 is interconnectably mounted with a pillow bearing box 32 through which the ram 26 passes to reduce the friction of the ram 26 within the shaft 24 during axial movement. The pillow bearing box 32 is also connected to the main support frame 28 as generally shown at 33.

The apparatus 10 is connected to the anchor 14 by connection means 34 located at a bottom end 36 of the drive shaft 24 to attach a first end 38 of the anchor 14 to the apparatus 10. The connection means 34 comprises adapter sleeve 40 mounted to the bottom end 36 of shaft 24 by means of bolt 41 and aperture 42. The adapter 44 fits within adapter sleeve 40 and is connected thereto by bolt 45 and aperture 46. The adapter 44 then connects to the first end 38 of anchor 14 by bolt 47 and aperture 48. The adapter 44 may be of different size in diameter at 50 so as to fit snugly within differing sizes of anchor 14.

In use, the apparatus 10 transfers sufficient axial force from the hydraulic motor 18 to the anchor 14 to maintain advancement of the anchor 14 into the subsoil of the ground 16 and sufficient torque to the anchor 14 to cause rotation of the anchor 14 upon application of the axial force to allow the anchor 14 to be inserted into the subsoil of the ground 16.

Figure 2:
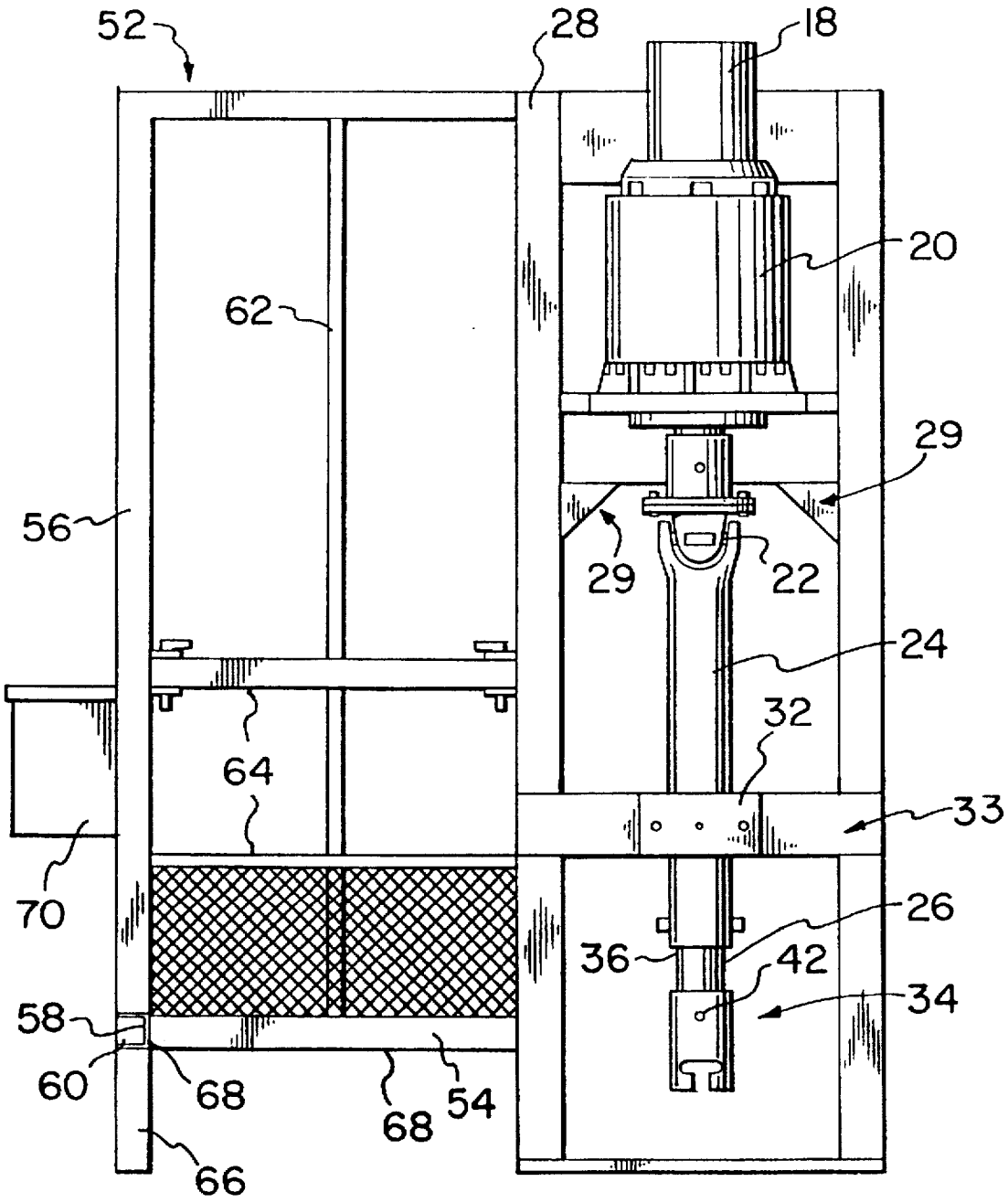
FIG. 2 is a side plan view of the invention.
Figure 3:
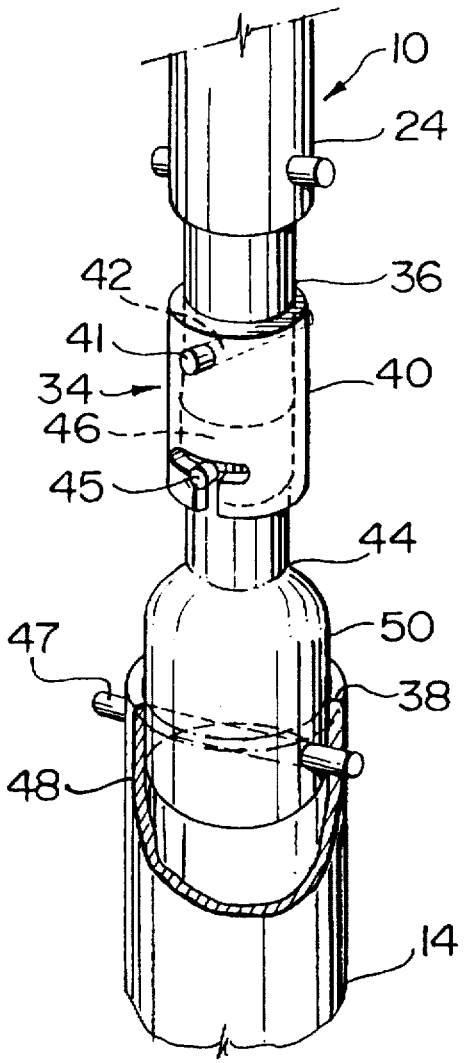
FIG. 3 is a perspective view of the connection means of the invention to the anchor.

As best illustrated in FIG. 2, connected to the main support frame 28 there is provided an enclosure 52 for holding spare anchors (not shown). The enclosure 52 comprises a bottom member 54 extending normal from the main support frame 52 and having a pair of upstanding members 56 at an outer extremity 58 of said bottom member 54 and connected by a pair of cross members 60 extending normal thereto. There is further provided a support member 62 extending upwardly from said bottom member 54. A plurality of cross-members 64 running substantially parallel and co-planar with said bottom member 54 connect said upstanding members 56 with said main support frame 28. There is further provided a downwardly extending member 66 from a bottom surface 68 of said bottom member 54. For the convenience of the operator, there is a tool box 70 attached to the enclosure 52.

In order to determine the axial load and torque required to implant the anchor 14 into the subsoil of the ground 16, there is provided a first load bearing measuring device 72. Said first device 72 is comprised of a two way pressure valve 74 connected by pressure hoses 76 to a pressure gauge 78 and a control valve 80. The first device is then connected by pressure hose 82 to an input/output valve 84 on the hydraulic motor 18. Thus, the pressure required to implant the anchor 14 into the subsoil of the ground 16 may be measured thereby allowing the operator to determine if the density of the subsoil of the ground 16 at that location is sufficient to hold the anchor 14 in place during its load bearing use.

In use, the operator will have a target holding strength for the anchor 14 within the subsoil of the ground 16 based on the intended load-bearing application of the anchor 14. That holding strength will be converted to a target pressure, in appropriate pressure units of measure. The anchor 14 will be implanted into the subsoil of the ground 16 to a depth such that the density of the subsoil requires the target pressure be exerted on the anchor 14, as measured on the gauge 78, in order to meet the target holding strength for the intended load-bearing application. Once the gauge 78 reaches a pre-determined amount, the operator will be confident that the anchor 14 is implanted to a sufficient depth within the subsoil of the ground 16.

Figure 4:
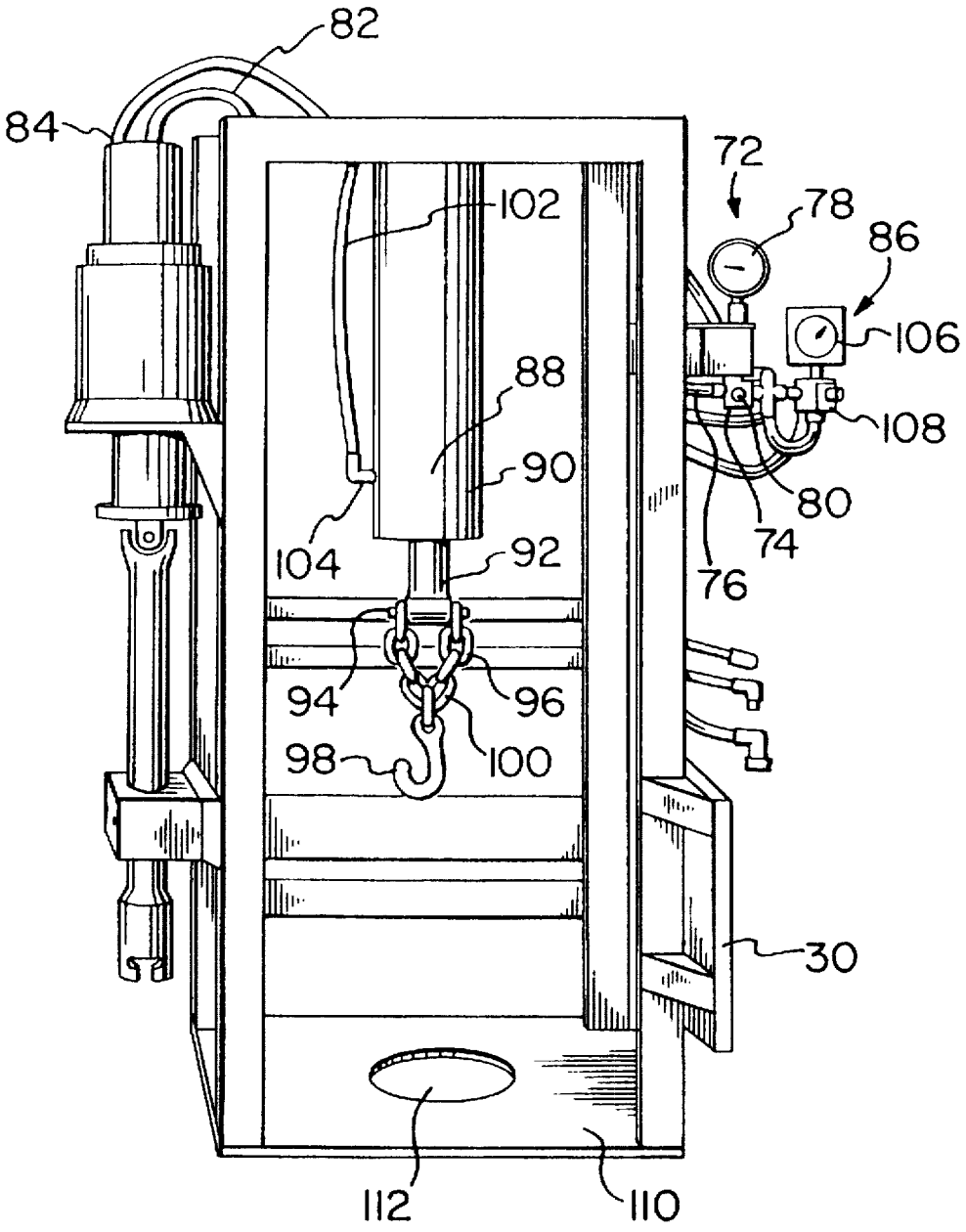
FIG. 4 is a front plan view of the invention.

Once the anchor 14 is in place in the subsoil of the ground 16, it is a government requirement to ensure that holding strength of the anchor 14 within the subsoil of the ground 16 meets or exceeds a pre-determined limit to confirm that the anchor 14 will be able to withstand the load placed upon it in use, without pulling free from the subsoil of the ground 16. There is thus provided a second load bearing measuring device 86 on the apparatus 10 as best illustrated in FIG. 4.

The second load bearing measuring device 86 comprises a hydraulic ram 88 within a sleeve 90 having a downwardly oriented extension 92. Said extension 92 is connected by bolts 94 to a chain 96 having hook 98 connected to a bottom portion 100 thereof for releasable engagement with the first end 38 of anchor 14.

The ram 88 is connected by hoses 102 from an input/output valve 104 on the ram 88 to the pressure gauge 78 and to pressure recorder 106 and pressure control valve 108.

In use, the skid-steer loader 12 lowers the main support frame 28 of the apparatus 10 to a position whereby the bottom platform 110 of the frame 28 comes in contact with the ground 16 so that the surface area of said bottom platform 110 evenly distributes the load being exerted during the selectively incremental increasing upwards force on the anchor 14. There is provided in said bottom platform 110 an aperture 112 through which the anchor 14 is pulled during testing.

In order to measure the holding force of the anchor 14 within the subsoil of the ground 16, the operator selectively incrementally increases the pressure that is applied to the anchor 14 by varying the fluid pressure delivered to the ram 88 by means of the control valve 108. The pressure being exerted is measured on gauge 78 and recorded on recorder 106 until such time as the anchor 14 pulls free from the subsoil of the ground 16 or the pressure reaches a pre-determined limit based on the known requirements of that load-bearing application in axial force units of measure, converted to pressure units of measure. The recorder 106 can be used to produce a chart (not shown) of pressures exerted during the pull, which pressures can then be converted to axial force units of measure to satisfy the government requirement for holding strength of the anchor 14 within the subsoil of the ground 16 for the given application.

The apparatus thus described and the method of using the apparatus, mountable to a conventional skid-steer loader, to implant a screw-in piling or anchor while measuring the torque necessary to do so and then measuring the holding force of the anchor within the subsoil of the ground therefore overcome many of the disadvantages of the prior art by providing a single apparatus which can perform all three desired functions while adapted to be used on rough or uneven terrain.

Thus, it is apparent that there has been provided in accordance with the invention an apparatus for use in implanting screw-in pilings or anchors into the subsoil of the ground that fully satisfies the objects, aims and advantages set forth above. While the invention has been described in conjunction with example embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

The embodiments of the invention in which an exclusive property or privilege is claimed are defined ad follows:

1. An apparatus mountable to a skid-steer loader for the implanting of a screw-in piling or anchor into the subsoil comprising:

connection means to connect the apparatus to the screw-in piling or anchor, said connection means comprising a longitudinally extending enclosure having a generally cylindrical interior and open at a bottom end, a laterally oriented aperture within said enclosure, a laterally oriented aperture contained within said screw-in piling or anchor and a bolt to pass through said apertures and secure said enclosure to said screw-in piling or anchor;

means for producing axial force sufficient to maintain advancement of the screw-in piling or anchor into the subsoil and producing torque to maintain rotation of the screw-in piling or anchor upon application of said axial force sufficient to insert the screw-in piling or anchor into the subsoil;

a first load bearing measuring means connected to said insertion means, to measure load required to insert the screw-in piling or anchor into the subsoil, said first load bearing measuring means comprising a pressure gauge to measure the axial force and torque required to implant the screw-in piling or anchor into the subsoil; and a second load bearing measuring means releasably attachable to the screw-in piling or anchor by means of a chain and hook combination, said second load bearing measuring means comprising a hydraulic ram having a connection means to the screw-in piling or anchor, means for delivering a selectively incremental increasing upwards force on the screw-in piling or anchor implanted into the subsoil and a pressure gauge to measure said force being exerted on said screw-in piling or anchor.

2. The apparatus of claim 1 including a pressure recorder to record the pressure from the pressure gauge.

* * * * *